US011562703B2

(12) United States Patent
Lee et al.

(10) Patent No.: US 11,562,703 B2
(45) Date of Patent: Jan. 24, 2023

(54) DRIVING DISPLAY APPARATUS AND METHOD ACQUIRING CURRENT DUTY TO DRIVE BACKLIGHT UNIT BASED ON EXCLUDING TEXT AREA IN INPUT IMAGE

(71) Applicant: SAMSUNG ELECTRONICS CO., LTD., Suwon-si (KR)

(72) Inventors: Huijung Lee, Suwon-si (KR); Hwaseok Seong, Suwon-si (KR); Gangmo Koo, Suwon-si (KR); Younghun Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/278,984

(22) PCT Filed: Dec. 7, 2018

(86) PCT No.: PCT/KR2018/015529
§ 371 (c)(1),
(2) Date: Mar. 23, 2021

(87) PCT Pub. No.: WO2020/075913
PCT Pub. Date: Apr. 16, 2020

(65) Prior Publication Data

US 2022/0036837 A1 Feb. 3, 2022

(30) Foreign Application Priority Data

Oct. 11, 2018 (KR) ..... 10-2018-0121254

(51) Int. Cl.
*G09G 3/36* (2006.01)
*G09G 3/34* (2006.01)

(52) U.S. Cl.
CPC ..... *G09G 3/3426* (2013.01); *G09G 3/3611* (2013.01); *G09G 2320/062* (2013.01);
(Continued)

(58) Field of Classification Search
CPC ..... G09G 3/3426; G09G 3/36; G09G 3/3611; G09G 3/3614; G09G 3/3644;
(Continued)

(56) References Cited

U.S. PATENT DOCUMENTS 5,767,978 A * 6/1998 Revankar ..... H04N 1/40062 358/448
7,595,784 B2 9/2009 Yamamoto et al.
(Continued)

FOREIGN PATENT DOCUMENTS

EP 2 221 796 A2 8/2010
JP 2009-192804 A 8/2009
(Continued)

OTHER PUBLICATIONS

Communication dated Jul. 21, 2021, from the European Patent Office in European Application No. 18936613.1.
(Continued)

*Primary Examiner* — Alexander Eisen
*Assistant Examiner* — Nelson Lam
(74) *Attorney, Agent, or Firm* — Sughrue Mion, PLLC

(57) ABSTRACT

A display device is disclosed. The display device comprises a display panel, a backlight unit, and a processor for driving the backlight unit so as to provide light to the display panel, wherein the processor is capable of acquiring a current duty for driving the backlight unit, on the basis of pixel information of an area excluding a text area in an input image, and driving the backlight unit on the basis of the acquired current duty.

16 Claims, 16 Drawing Sheets

(52) U.S. Cl.
CPC ..... *G09G 2320/0646* (2013.01); *G09G 2330/021* (2013.01)

(58) Field of Classification Search
CPC ..... G09G 3/3648; G09G 3/3666; G09G 2320/062; G09G 2320/0626; G09G 2320/0623; G09G 2320/064; G09G 2320/0646; G09G 2320/0686
USPC ..... 345/87–104
See application file for complete search history.

(56) References Cited

U.S. PATENT DOCUMENTS

| | | | | |
|---|---|---|---|---|
| 8,232,956 | B2 | 7/2012 | Fujine et al. | |
| 8,749,471 | B2 * | 6/2014 | Jang | G09G 3/3611 345/204 |
| 8,760,385 | B2 | 6/2014 | Kwon et al. | |
| 8,982,035 | B2 | 3/2015 | Seo et al. | |
| 2010/0214209 | A1 * | 8/2010 | Seo | G09G 3/342 345/102 |
| 2011/0175859 | A1 | 7/2011 | Jang et al. | |
| 2015/0109346 | A1 * | 4/2015 | Taniguchi | G09G 3/3611 345/690 |
| 2018/0233093 | A1 * | 8/2018 | Chu | G09G 3/36 |

FOREIGN PATENT DOCUMENTS

| | | | |
|---|---|---|---|
| JP | 5156791 | B2 | 3/2013 |
| JP | 2013-130744 | A | 7/2013 |
| KR | 10-2007-0002751 | A | 1/2007 |
| KR | 10-0934070 | B1 | 12/2009 |
| KR | 10-1090655 | B1 | 12/2011 |
| KR | 10-1329969 | B1 | 11/2013 |
| KR | 10-1543277 | B1 | 8/2015 |
| KR | 10-1777867 | B1 | 9/2017 |

OTHER PUBLICATIONS

International Search Report dated Jul. 10, 2019 issued by the International Searching Authority in counterpart International Application No. PCT/KR2018/015529 (PCT/ISA/210).

International Written Opinion dated Jul. 10, 2019 issued by the International Searching Authority in counterpart International Application No. PCT/KR2018/015529 (PCT/ISA/237).

Gangmo Koo, "2017 Advanced Ultimate Contract Project ER2 Report", Dec. 22, 2017, 14 pages total, Cited in ISA Search Report dated Jul. 10, 2019 in App. No. PCT/KR2018/015529.

* cited by examiner

DRIVING DISPLAY APPARATUS AND METHOD ACQUIRING CURRENT DUTY TO DRIVE BACKLIGHT UNIT BASED ON EXCLUDING TEXT AREA IN INPUT IMAGE

TECHNICAL FIELD

The disclosure relates to a display apparatus and a driving method thereof. More particularly, the disclosure relates to a display apparatus including a backlight and a driving method thereof.

BACKGROUND DESCRIPTION

A liquid crystal display is configured to form a liquid crystal layer having anisotropic dielectric constant on upper and lower transparent insulating substrates, and change a molecular arrangement of a liquid crystal material by adjusting an intensity of an electric field formed in the liquid crystal layer, thereby displaying a desired image by adjusting the amount of light transmitted to the transparent insulating substrate.

A thin film transistor liquid crystal display (TFT LCD) that uses a thin film transistor (TFT) as a switching element is mainly used as a liquid crystal display, and the liquid crystal display is composed of a liquid crystal panel that displays an image composed of pixels divided into cross-arranged gate lines and data lines, a driver that drives the liquid crystal panel, a backlight unit that supplies light to the liquid crystal panel, and a color filter that transmits light supplied to the liquid crystal panel.

However, power consumption of light source of the backlight unit and an inverter circuit for driving the light source is almost half of a total power consumption of the liquid crystal display. Accordingly, a method of reducing the power consumption of the backlight unit is effective in order to reduce the power consumption of the liquid crystal display apparatus. A backlight dimming method is most widely used as a method for reducing power consumption of the backlight unit.

According to the backlight dimming method, a current value for backlight dimming is determined based on pixel information of an image, but there is a problem in that the current value may be determined too high when a high-gradation text such as subtitles is included in an image.

DETAILED DESCRIPTION OF THE INVENTION

Technical Problem

An object of the disclosure is to provide a display apparatus configured to locally dim backlight so as to prevent changes in brightness and deterioration of black visibility even when the high-gradation text such as subtitles is included in an image.

Technical Solution

According to an embodiment of the disclosure, a display apparatus includes a display panel, a backlight unit, and a processor configured to drive the backlight unit so as to provide light to the display panel, wherein the processor is configured to acquire a current duty for driving the backlight unit, based on pixel information of an area excluding a text area in an input image, and drive the backlight unit based on the acquired current duty.

The processor may be configured to identify the input image as a plurality of block areas, acquire feature information on each of the plurality of block areas, and identify the text area based on the acquired feature information.

The feature information may be configured to include at least one of first pixel information including pixel values equal to or greater than a predetermined threshold gradation or second pixel information including edge area pixel values.

The processor may be configured to identify the text area based on at least one among at least one ratio of the first pixel information or the second pixel information, a center of gravity, or a degree of dispersion.

The backlight unit may include a plurality of backlight blocks, and wherein the processor is configured to identify the input image as a plurality of areas corresponding to the plurality of backlight blocks, respectively, and acquire a plurality of current duties for driving the plurality of backlight blocks corresponding to the plurality of areas based on pixel information excluding pixel information of an area corresponding to the text area in the plurality of areas, respectively.

The processor may be configured to, based on position information on the text area being received, identify a position of the text area in the input image based on the position information.

The text area may be configured to include at least one of a subtitle area or a log area.

The display panel may be a liquid crystal panel.

According to an embodiment of the disclosure, a method of driving a display apparatus includes acquiring a current duty configured to drive a backlight unit based on pixel information of an area excluding a text area in an input image, and driving the backlight unit based on the acquired current duty.

The acquiring the current duty of claim may include identifying the input image as a plurality of block areas, acquiring feature information on each of the plurality of block areas, and identifying the text area based on the acquired feature information.

The feature information may be configured to include at least one of first pixel information including pixel values equal to or greater than a predetermined threshold gradation or second pixel information including edge area pixel values.

The identifying the current duty may include identifying the text area based on at least one among at least one ratio of the first pixel information or the second pixel information, a center of gravity, or a degree of dispersion.

The backlight unit may include a plurality of backlight blocks, and wherein the identifying the current duty comprise identifying the input image as a plurality of areas corresponding to the plurality of backlight blocks, respectively, and acquiring a plurality of current duties for driving the plurality of backlight blocks corresponding to the plurality of areas based on pixel information excluding pixel information of an area corresponding to the text area in the plurality of areas, respectively.

The acquiring the current duty may include, based on position information on the text area being received, identifying a position of the text area in the input image based on the position information.

The text area may be configured to include at least one of a subtitle area or a log area.

The display panel may be a liquid crystal panel.

A non-transitory computer-readable medium storing computer instruction for causing a display apparatus to perform an operation based on executed by a processor of the display apparatus, wherein the operation may include acquiring a current duty configured to drive a backlight unit based on pixel information of an area excluding a text area in an input image, and driving the backlight unit based on the acquired current duty.

As described above, according to various embodiments of the disclosure, even if a high-gradation text such as a caption is included in an image, a change in brightness and deterioration of black visibility may be prevented, thereby improving user convenience.

BEST MODE FOR IMPLEMENTING THE DISCLOSURE

Mode for Implementing the Disclosure

Figure 1:
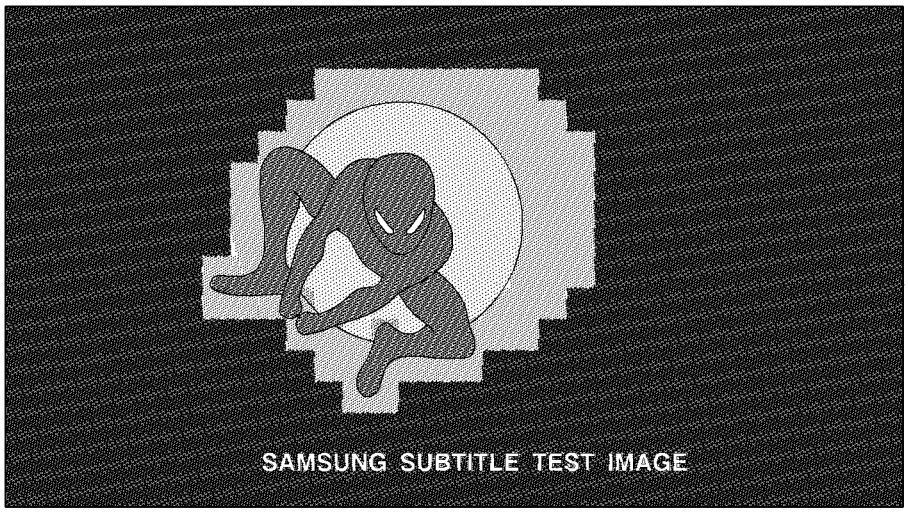
FIG. 1 is a view illustrating characteristic of a display panel according to an embodiment of the disclosure.

Hereinafter, the disclosure will now be explained in detail with reference to the accompanying drawings.

The terms used in example embodiments will be briefly explained, and example embodiments will be described in greater detail with reference to the accompanying drawings.

Terms used in the present disclosure are selected as general terminologies currently widely used in consideration of the configuration and functions of the present disclosure, but can be different depending on intention of those skilled in the art, a precedent, appearance of new technologies, and the like. Further, in specific cases, terms may be arbitrarily selected. In this case, the meaning of the terms will be described in the description of the corresponding embodiments. Accordingly, the terms used in the description should not necessarily be construed as simple names of the terms, but be defined based on meanings of the terms and overall contents of the present disclosure.

The terms "have", "may have", "include", and "may include" used in the exemplary embodiments of the present disclosure indicate the presence of corresponding features (for example, elements such as numerical values, functions, operations, or parts), and do not preclude the presence of additional features.

The term "at least one of A or/and B" means including at least one A, including at least one B, or including both at least one A and at least one B.

The term such as "first" and "second" used in various exemplary embodiments may modify various elements regardless of an order and/or importance of the corresponding elements, and does not limit the corresponding elements.

If it is described that a certain element (e.g., first element) is "operatively or communicatively coupled with/to" or is "connected to" another element (e.g., second element), it should be understood that the certain element may be connected to the other element directly or through still another element (e.g., third element).

Singular forms are intended to include plural forms unless the context clearly indicates otherwise. The terms "comprise" or "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

In addition, the terms "module" or "unit" used in exemplary embodiments indicates an element performing one or more functions or operations, and may be implemented by using hardware or software or a combination of hardware and software. In addition, a plurality of "modules" or a plurality of "units" may be integrated into one or more modules, except that a "module" or "unit" needs to be implemented by specific hardware, and may be implemented as at least one processor (not shown).

Hereinafter, exemplary embodiments will be described in greater detail with reference to the accompanying drawings.

FIG. 1 is a view illustrating characteristic of a display panel according to an embodiment of the disclosure.

A display panel implemented with a device that does not emit light by itself, for example, a liquid crystal display (LCD) panel, needs to have a backlight in a display module to implement an image. When the backlight is activated, for example, a 46-inch, CCFL-based LCD TV consumes a total of 240 W. Even when activation of the backlight is not absolutely necessary, such as in a dark scene, it always operates at 100%, and as power increases, a temperature of the backlight and display module also increases. This may affect LCD characteristics due to an excessive thermal gradient of heat radiated by the backlight. For this reason, brightness of the backlight, that is, power consumption is limited as much as possible.

As a method for reducing the power consumption of the backlight, backlight dimming is the most widely used. The backlight dimming may classify into local dimming, which divides a screen into a plurality of areas and individually controls brightness of the backlight for each area, and global dimming, which collectively lowers the backlight brightness of an entire screen. According to an embodiment of the disclosure, the backlight may be controlled according to the local dimming.

Meanwhile, as shown in FIG. 1, a driving method using a backlight has a problem in that a degree of visibility of brightness change is high and black visibility is deteriorated as the subtitles or texts of high gradation appear and disappear in a dark image containing a letter box or low luminance in the input image.

Accordingly, the following will describe various embodiments capable of preventing brightness change and deterioration of black visibility even if text with a high-gradation such as subtitles included in an image.

Figure 2:
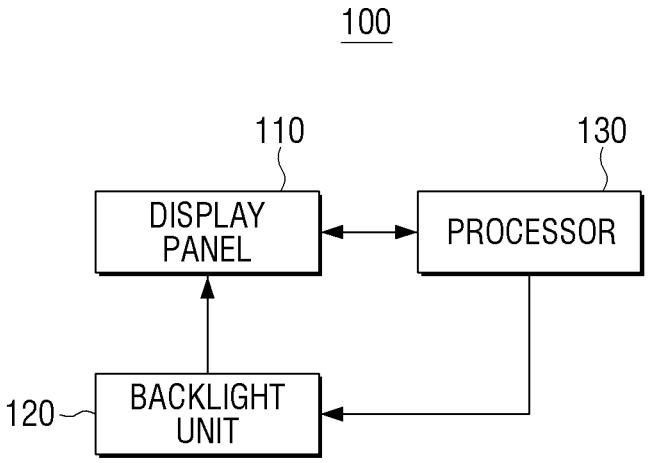
FIG. 2 is a block diagram illustrating a configuration of a display apparatus according to an embodiment of the disclosure.

FIG. 2 is a block diagram illustrating a configuration of a display apparatus according to an embodiment of the disclosure.

Referring to FIG. 2, the display apparatus 100 includes a display panel 110, a backlight unit 120, and a processor 130.

The display apparatus 100 may be implemented as a smartphone, a tablet, a smart TV, an Internet TV, a web TV, an internet protocol television (IPTV), a signage, a PC, a smart TV, a monitor, or the like, but is not limited thereto. It may be implemented with various types of devices with display functions, such as a large format display (LFD), digital signage, digital information display (DID), video wall, projector display, or the like.

The display panel 110 may include a plurality of pixels, and each pixel may be formed of a plurality of subpixels. For example, each pixel may be composed of three sub-pixels corresponding to a plurality of lights, for example, red, green, and blue lights (R, G, B). However, the it is not limited thereto, and in some cases, cyan, magenta, yellow, black, or other subpixels may be included in addition to the red, green, and blue subpixels. The display panel 110 may be implemented as a liquid crystal panel. However, if backlight dimming according to an embodiment of the disclosure is applicable, it may be implemented as a display panel of another type.

The backlight unit 120 irradiates light to the display panel 110.

In particular, the backlight unit 120 irradiates light to the display panel 110 from a rear surface of the display panel 110, that is, an opposite surface of a surface on which an image is displayed.

The backlight unit 120 may include a plurality of light sources, and the plurality of light sources may include a linear light source such as a lamp or a point light source such as a light emitting diode, but is not limited thereto. The backlight unit 120 may be implemented as a direct type backlight unit or an edge type backlight unit. The light source of the backlight unit 120 may include any one or two or more light sources of light Emitting Diode (LED), Hot cathode fluorescent lamp (HCFL), cold cathode fluorescent lamp (CCFL), external electrode fluorescent lamp (EEFL), ELP, or FFL.

According to an embodiment, the backlight unit 120 may be implemented as a plurality of LED modules and/or a plurality of LED cabinets. In addition, the LED module may include a plurality of LED pixels, and according to an example, the LED pixel may be implemented as an RGB LED, and the RGB LED may include a RED LED, a GREEN LED, and a BLUE LED together.

The processor 130 controls the overall operation of the display apparatus 100.

According to an embodiment, the processor 130 may be implemented as a digital signal processor (DSP), a microprocessor, or a time controller (TCON), but is not limited thereto, and may include one or more of a central processing unit (CPU), microcontroller unit (MCU), micro processing unit (MPU), controller, application processor (AP), graphics-processing unit (GPU), or communication processor (CP), an ARM processor, or may be defined in a corresponding term. In addition, the processor 130 may be implemented as a system on chip (SoC) with a built-in processing algorithm, and a large scale integration (LSI). The processor 130 may be implemented in the form of a field programmable gate array (FPGA), and the processor 130 may perform various functions by executing computer executable instructions stored in the memory 120.

The processor 130 may drive the backlight unit 120 to provide light to the display panel 110. Specifically, the processor 130 may adjust and output at least one of a supply time and intensity of a driving current (or driving voltage) supplied to the backlight unit 130.

Specifically, the processor 130 may control luminance of light sources included in the backlight unit 120 by pulse width modulation (PWM) with a variable duty ratio, or control luminance of light sources of the backlight unit 120 by varying the intensity of a current. A pulse width modulated (PWM) signal may control a ratio of turning on and off the light sources, and a duty ratio (%) may be determined according to a dimming value input from the processor 130.

In this case, the processor 130 may be implemented in a form including a driver IC for driving the backlight unit 120. For example, the processor 130 may be implemented as a DSP, and may be implemented as a digital driver IC and one chip. However, the driver IC may be implemented as hardware separate from the processor 130. For example, when the light sources included in the backlight unit 120 are implemented as LED devices, the driver IC may be implemented as at least one LED driver that controls a current applied to the LED devices. According to an embodiment, the LED driver may be disposed at a rear end of a power supply (e.g., a switching mode power supply (SMPS)) to receive a voltage from the power supply. However, according to another embodiment, a voltage may be applied from a separate power supply device. Alternatively, the SMPS and the LED driver may be implemented in a single integrated module.

The processor 130 obtains a dimming ratio for driving the backlight unit 120, that is, a lighting duty of current (hereinafter referred to as a current duty) based on pixel information (or pixel physical quantity) of an input image. The pixel information may be at least one of an average pixel value, a maximum pixel value (or a peak pixel value), a minimum pixel value and an intermediate pixel value, and an average picture level (APL) of each block area. In this case, the pixel value may include at least one of luminance value (or a gradation value) and a color coordinate value. Hereinafter, for convenience of description, it is assumed that APL is used as pixel information.

The processor 130 may obtain a dimming ratio for driving the backlight unit 120 for each section, that is, a current duty, based on pixel information for each section of the input image, for example, APL information. Ap predetermined section may be a frame unit, but is not limited thereto, and may be a plurality of frame sections, scene sections, or the like. In this case, the processor 130 may obtain a current duty based on pixel information based on a predetermined function (or calculation algorithm), but current duty information according to the pixel information may be pre-stored in a form of, for example, a lookup table or graph.

For example, the processor 130 may convert a pixel data RGB for each frame into a luminance level according to a predetermined conversion function, and divide a sum of the luminance levels by a total number of pixels to calculate an APL for each frame. However, the it is not limited thereto, and various conventional APL calculation methods may be used. The processor 130 may control a current duty to 100% in an image frame in which the APL is a predetermined value (e.g., 80%), and determine a current duty corresponding to each APL value by using by using a function that reduces a current duty of an image frame having an ALP value of 80% or less to be linearly or non-linearly inversely proportional to the APL value. However, when the current duty corresponding to the APL value is stored in the lookup table, the current duty may be derived from the lookup table using the APL as a read address.

Meanwhile, the processor 130 may drive the backlight unit 120 with local dimming, which identifies the screen as a plurality of areas and individually controls backlight luminance for each area.

Specifically, the processor 130 may identify the screen as a plurality of screen areas that can be separately controlled according to an implementation form of the backlight unit 120, and acquire a current duty for driving light sources of the backlight unit 120, respectively, corresponding to each image area based on the APL information. Hereinafter, for convenience of description, each backlight area corresponding to the plurality of image areas is referred to as a backlight block. For example, each of the backlight blocks may include at least one light source, for example, a plurality of light sources.

Figure 3A:
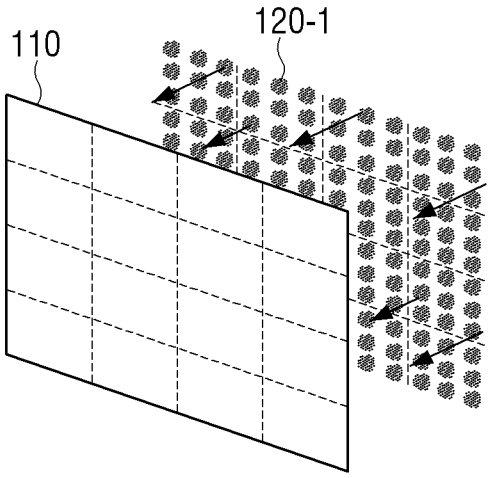
FIGS. 3A and 3B are views illustrating a local dimming method according to an embodiment of the disclosure.

According to an embodiment, the backlight unit 120 may be implemented as a direct type backlight unit 120-1 as illustrated in FIG. 3A. For example, the direct type backlight unit 120-1 may be implemented in a structure in which a plurality of optical sheets and a diffusion plate are stacked under the display panel 110 and a plurality of light sources are disposed under the diffusion plate.

The direct type backlight unit 120-1, as shown in FIG. 3A, based on an arrangement structure of the plurality of light sources, it may be divided into a plurality of backlight blocks. In this case, each of the plurality of backlight blocks may be driven according to a current duty based on image information of a corresponding screen area, as illustrated.

Figure 3B:
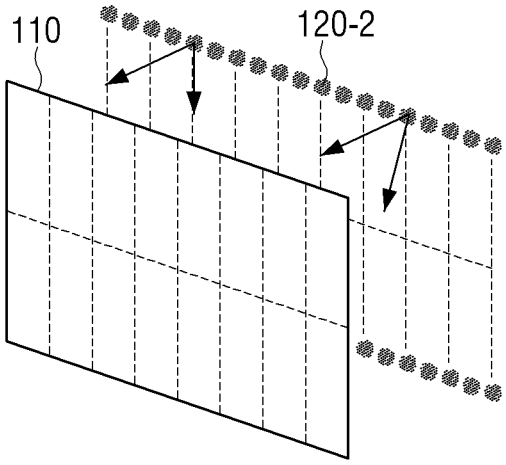

According to another embodiment, the backlight unit 120 may be implemented as an edge type backlight unit 120-2 as shown in FIG. 3B. For example, the edge type backlight unit 120-2 may be implemented in a structure in which a plurality of optical sheets and a light guide plate are stacked under the display panel 110 and a plurality of light sources are disposed on the side of the light guide plate.

The edge type backlight unit 120-2, as shown in FIG. 3B, based on the arrangement structure of the plurality of light sources, it may be divided into a plurality of backlight blocks. In this case, each of the plurality of backlight blocks may be driven according to a current duty based on image information of a corresponding screen area, as illustrated.

According to an embodiment of the disclosure, the processor 130 may acquire a current duty for driving the backlight unit 120 based on pixel information of an area other than a text area in an input image. The text area may be an overlay text area such as a subtitle area, a text area included in OSD, a broadcaster logo area. Also, the text area may be an area including a text pixel and an area surrounding the text.

Specifically, when acquiring pixel information of an image area corresponding to each backlight block, the processor 130 may acquire a current duty for driving each backlight block based on pixel information of an area other than the text area.

Figure 4A:
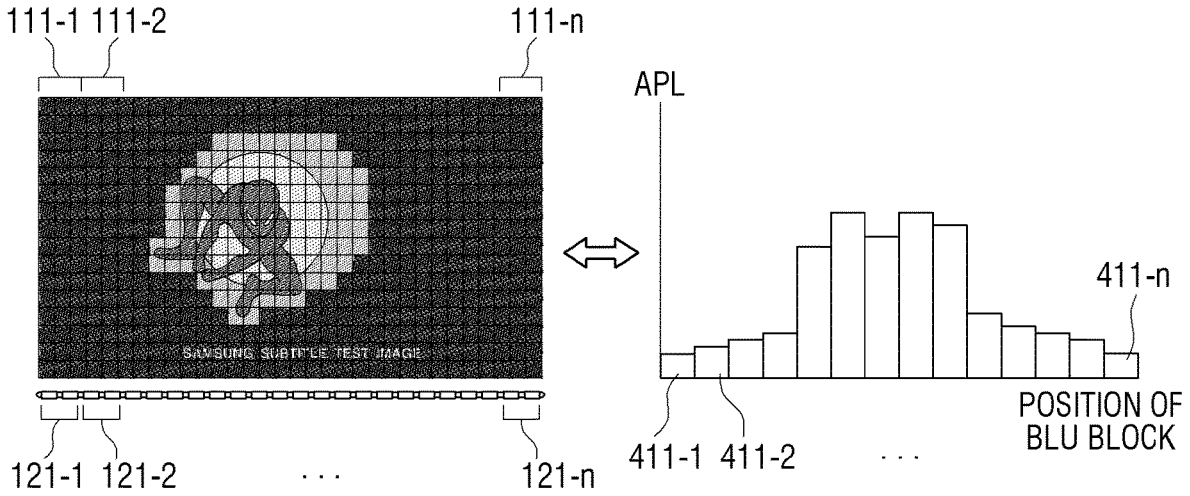
FIGS. 4A to 4C are views illustrating a method for obtaining a current duty corresponding to each backlight block according to an embodiment of the disclosure.
Figure 4B:
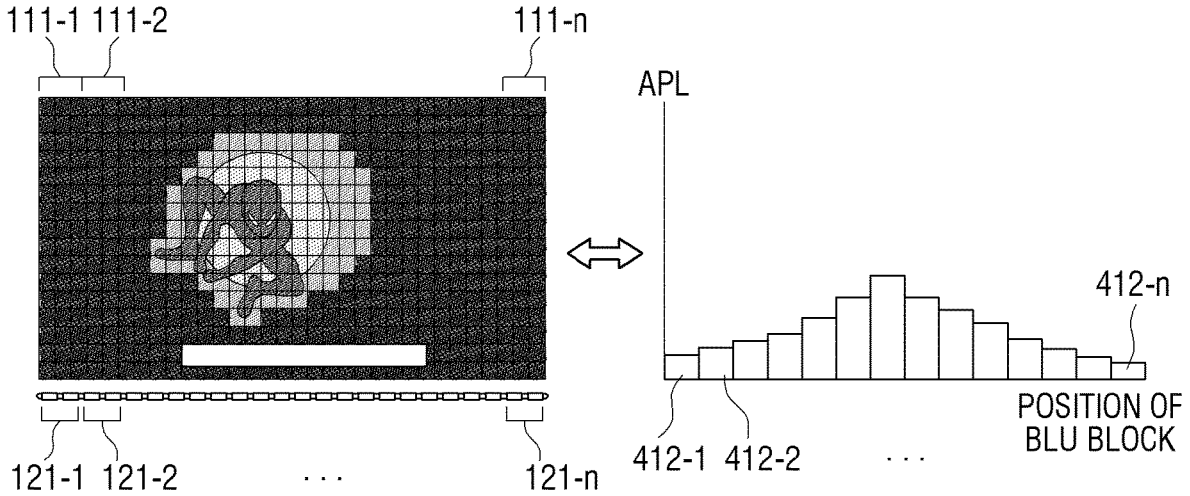

FIGS. 4A and 4B are views illustrating a method of acquiring a current duty corresponding to each backlight block according to an embodiment of the disclosure.

When implemented as the edge-type backlight unit 120-2 according to an embodiment of the disclosure, the processor 130 may acquire pixel information, for example, APL information, of each image area to be displayed on a screen area corresponding to each backlight block of the backlight unit 120-2, and calculate a current duty of a backlight block corresponding to the screen area based on the acquired pixel information.

For example, the processor 130 may calculate APL information of image areas 111-1 to **111-*n* corresponding to each of the backlight blocks 121-1 to 121-*n*, as illustrated on the right side of FIG. 4A. For example, the left side of FIG. 4B shows APL values (411-1 to 411-*n*) of each image area (111-1 to 111-*n***).

However, according to the embodiment of the disclosure, the processor 130 may acquire APL information by considering only pixel information of an area other than a text area, as illustrated in FIG. 4B. In this case, unlike FIG. 4A, the processor 130 may acquire lower APL information in a portion where the text area is located. The text area may be an area including a text pixel and a surrounding pixel area of the text. However, in some cases, it is also possible to obtain APL information in consideration of pixel information of the remaining areas excluding only pure text pixels.

Figure 4C:
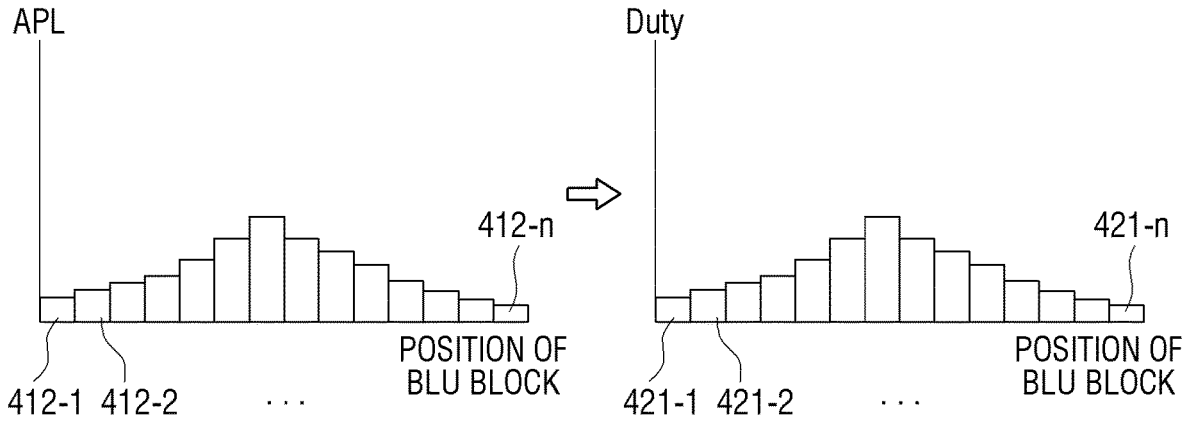

As shown in FIG. 4C, the processor 130 may calculate current duty (421-1 to **421-*n*) of each backlight block corresponding to each screen area based on an APL value of each image area obtained in FIG. 4B, that is, the APL value of the image area other than the text area. For example, the current duty of each backlight block 121-1 to 121-*n*** may be calculated by applying a predetermined weight value to the ALP value of each image area. For example, a current duty of an image area having an APL of 10% may be calculated as 10%*6=60%, and a current duty of an image area having an APL of 7% may be calculated as 7%*6=42%. However, it is only an example of calculating the current duty, and the current duty may be calculated in various ways based on pixel information of each screen area.

Meanwhile, according to an exemplary embodiment, the processor 130 may arrange a current duty corresponding to each backlight block according to a connection order of each backlight block and supply it to a local dimming driver. In this case, the local dimming driver generates a pulse width modulation (PWM) signal having each current duty provided from the processor 130, and sequentially drives each backlight block based on the generated PWM signal. According to another embodiment, the processor 130 may generate a pulse width modulated signal based on the calculated current duty and provide it to the local dimming driver.

According to an embodiment of the disclosure, the processor 130 may identify a text area based on pixel information, edge information, etc. of high-gradation corresponding to the text. The high-graduation may generally mean a gradation range used for text such as subtitles, or the like.

Figure 5A:
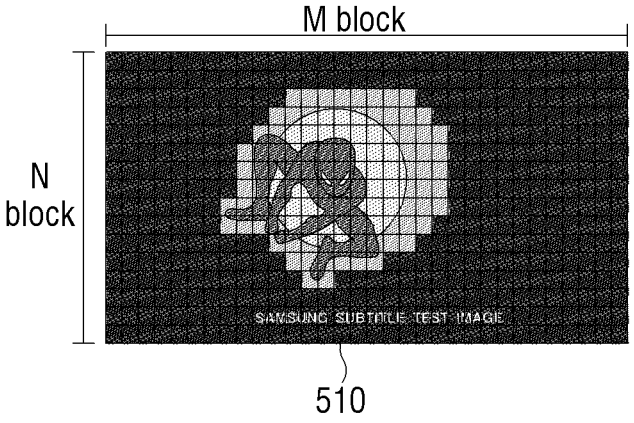
FIGS. 5A, 5B, and 6 are views illustrating a method of identifying a text area according to an embodiment of the disclosure.
Figure 5B:
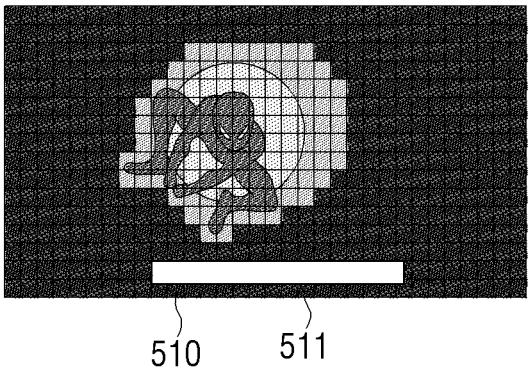
Figure 6:
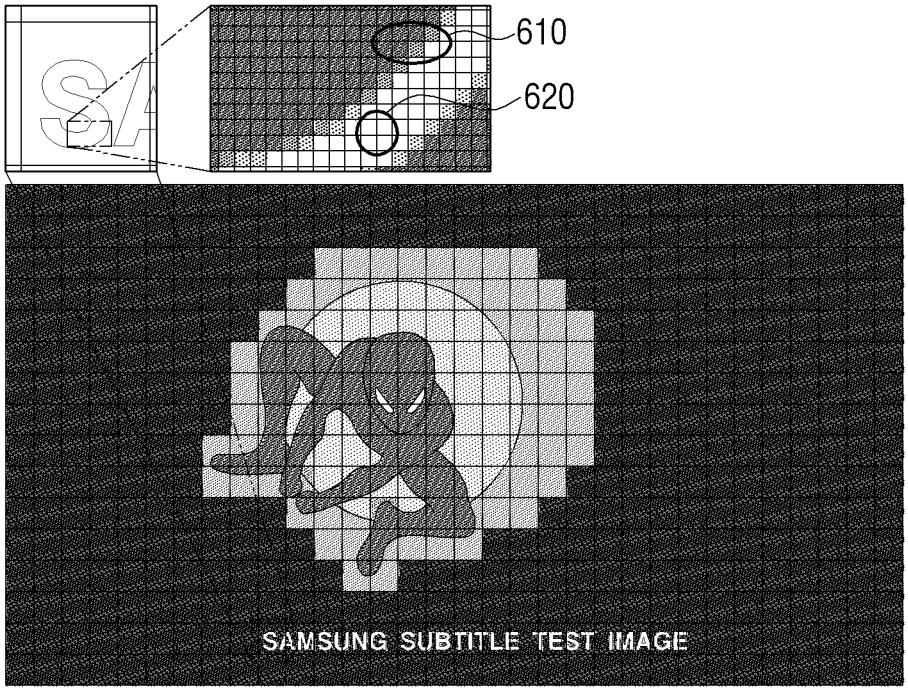

According to an embodiment, the processor 130 may identify an input image 510 as a plurality of block areas as shown in FIG. 5A, acquire feature information of each block area, and identify a text area 511 as shown in FIG. 5B based on the acquired feature information. The text area 511 may include at least one of first pixel information including pixel values equal to or greater than a predetermined threshold gradation or second pixel information including edge area pixel values.

For example, the processor 130 may identify a text area based on at least one of edge pixel information 610 including pixel values related to an edge area or high-gradation pixel information 620 including pixel values greater than or equal to a predetermined threshold gradation.

In this case, the processor 130 may identify the text area based on at least one of at least one ratio among edge pixel information 610 or high gradation pixel information 620, a center of gravity, or a degree of dispersion.

According to an example, the processor 130 may identify an input image as a plurality of block areas, and identify a text area based on a ratio of blocks in which an average value (or maximum value) of each block is high-gradation and low-gradation. According to another example, when a specific pixel area is identified based on the high-gradation pixel information and the edge pixel information, if a difference between centers of gravity of pixels having high-gradation pixel values and centers of gravity of pixels having edge pixel values in the specific pixel area falls within a predetermined range, the processor 130 may identify the corresponding area as a text area. According to another example, the processor 130 may identify a text area based on a degree to which a specific pixel physical quantity is distributed (or concentrated). The specific pixel physical quantity may be at least one of a low-gradation pixel value (e.g., a black pixel value) and a high-gradation pixel value.

According to another example, the processor 130 may detect a text frame and perform text localization on the text frame. The text frame may be detected by detecting a portion arranged at fixed intervals or a compressed domain portion of the input image. For example, the processor 130 may perform pre-processing such as edge extraction, etc. on the detected text frame and extract a linear portion through a linear extraction process such as Hough Transform of a pre-processed frame to extract an area containing text. Specifically, the processor 130 may detect a text line and text color, and detect a text area based on the detected text line and text color. The text area may be extracted in a rectangular shape, but is not limited thereto.

In some cases, position information on a text area (e.g., an OSD caption area) may be received together with an input image. In this case, the processor 130 may identify a position of the text area in the input image based on the position information, and use pixel information of the remaining areas except for the corresponding area.

Figure 7A:
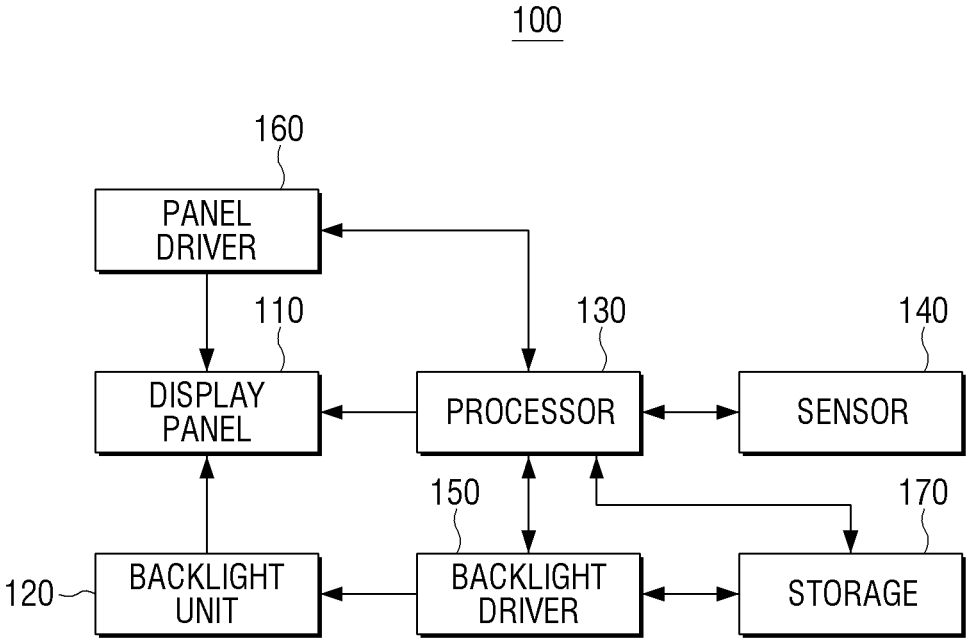
FIGS. 7A and 7B are views illustrating a detailed configuration of a display apparatus according to an embodiment of the disclosure.
Figure 7B:
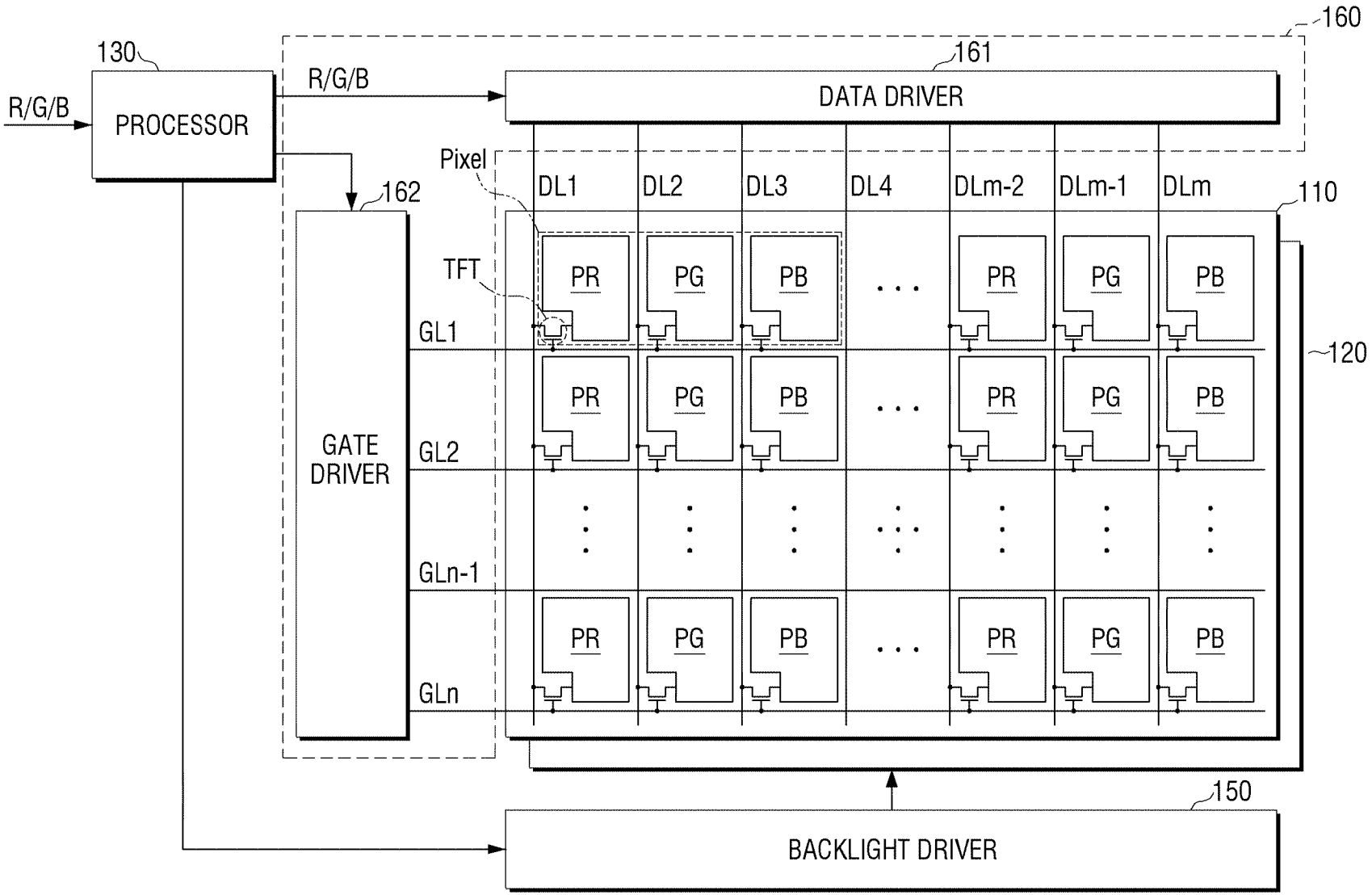

FIGS. 7A and 7B are views illustrating a detailed configuration of a display apparatus according to an embodiment of the disclosure.

According to FIG. 7A, the display apparatus 100 includes a display panel 110, a backlight unit 120, a processor 130, a sensor 140, a backlight driver 150, a panel driver 160, and a storage 170. A detailed description of the configuration shown in FIG. 11A that overlaps the configuration shown in FIG. 2 will be omitted.

The sensor 140 senses external light.

Specifically, the sensor 140 may detect at least one or more of various characteristics such as illuminance, intensity, color, incident direction, incident area, distribution, etc. of light. According to an implementation example, the sensor 130 may be an illuminance sensor, a temperature sensor, a light intensity sensing layer, a camera, or the like. In particular, the sensor 140 may be implemented as an illuminance sensor that senses RGB light, but is not limited thereto, and any device capable of light sensing such as a white sensor, an IR sensor, an IR+RED sensor, an HRM sensor, a camera, etc. are applicable thereto.

Meanwhile, at least one sensor 140 may be provided, and when a plurality of sensors 140 are provided and if the sensors are in positions that can measure illuminance in different directions, other positions may be applied. For example, a second sensor may be provided at a position capable of sensing illuminance in a different direction of an angle that differs by 90° or more compared to a first sensor. For example, the sensor 140 may be disposed inside a glass provided on the display panel 110.

The processor 130 may adjust a current duty of each backlight block based on an intensity of external light sensed by the sensor 130.

The display panel 110 is formed so that gate lines GL1 to GLn and data lines DL1 to DLm intersect each other, and R, G, and B subpixels PR, PG, and PB are formed in areas where the lines are intersected. Adjacent R, G, B sub-pixels PR, PG, and PB may form one pixel. In other words, each pixel may include an R subpixel (PR) representing red (R), a G subpixel (PG) representing green (G), and a B subpixel (PB) representing blue (B) to reproduce a color of a subject with three primary colors (R), green (G), and blue (B).

When the display panel 110 is implemented as an LCD panel, each sub-pixel (PR, PG, PB) may include a pixel electrode and a common electrode, and a light transmittance changes as a liquid crystal arrangement changes due to an electric field formed by a potential difference between the two electrodes. TFTs formed at the intersections of the gate lines GL1 to GLn and the data lines DL1 to DLm may supply video data from data lines DL1 to DLm, that is, red (R), green (G), blue (B) data to pixel electrodes of sub-pixels PR, PG, and PB, respectively, in response to scan pulses from each of the gate lines GL1 to GLn.

The backlight driver 150 may be implemented in a form including a driver IC for driving the backlight unit 120. According to an example, the driver IC may be implemented as hardware separate from the processor 130. For example, when light sources included in the backlight unit 120 are implemented as LED devices, the driver IC may be implemented as at least one LED driver that controls a current applied to the LED devices. According to an embodiment, the LED driver may be disposed at a rear end of a power supply (e.g., a switching mode power supply (SMPS)) to receive a voltage from the power supply. However, according to another embodiment, a voltage may be applied from a separate power supply device. Alternatively, the SMPS and the LED driver may be implemented in a single integrated module.

The panel driver 160 may be implemented in a form including a driver IC for driving the display panel 110. According to an example, the driver IC may be implemented as hardware separate from the processor 130. For example, the panel driver 160 may include a data driver 161 that supplies video data to data lines and a gate driver 162 that supplies scan pulses to gate lines.

The data driver 161 is a means for generating a data signal, and generates a data signal by receiving image data of an R/G/B component from the processor 130 (or a timing controller (not shown)). In addition, the data driver 161 may apply a data signal generated by being connected to data lines DL1, DL2, DL3 . . . , DLm of the display panel 110 to the display panel 110.

The gate driver 162 (or scan driver) is a means for generating a gate signal (or a scan signal) and is connected to the gate lines GL1, GL2, GL3 . . . , GLn to transmit the gate signal to a specific line of the display panel 110. A data signal output from the data driver 161 may be transmitted to a pixel to which the gate signal is transmitted.

In addition, the panel driver 160 may further include a timing controller (not shown). The timing controller (not shown) may receive an input signal IS, a horizontal synchronization signal Hsync, a vertical synchronization signal Vsync, a main clock signal MCLK, or the like from the processor 130, and generate an image data signal, a scan control signal, a data control signal, a light emission control signal, or the like to provide it to the display panel 110, the data driver 161, the gate driver 162, or the like.

The storage 170 may store various data required for the operation of the display apparatus 100.

In particular, the storage 170 may store data necessary for the processor 130 to perform various processes. For example, the processor 130 may be implemented as an internal memory such as ROM, RAM, etc. or may be implemented as a separate memory from the processor 130. In this case, the storage 170 may be implemented in a form of a memory embedded in the display apparatus 100 according to a purpose of storing data, or may be implemented in a form of a memory that is detachable to the display apparatus 100. For example, data for driving the display apparatus 100 may be stored in a memory embedded in the display apparatus 100, and data for a function of extending the display apparatus 100 may be stored in a memory which is attachable and detachable from the display apparatus 100. Meanwhile, the memory embedded in the display apparatus 100 may be implemented in a form such as a nonvolatile memory, a volatile memory, a flash memory, a hard disk drive (HDD) or a solid-state drive (SSD), and the memory attachable and detachable to the display apparatus 100 may be implemented in a form such as a memory card (e.g., a micro-SD card, a USB memory, etc.), an external memory (e.g., a USB memory) connectable to a USB port, or the like.

Meanwhile, according to another embodiment, the above-described information (e.g., current adjustment curve, pixel data compensation curve, etc.) stored in the storage 170 may be obtained from an external device with the information not stored in the storage 170. For example, some information may be received in real time from an external device such as a set-top box, an external server, a user terminal, or the like.

Figure 8:
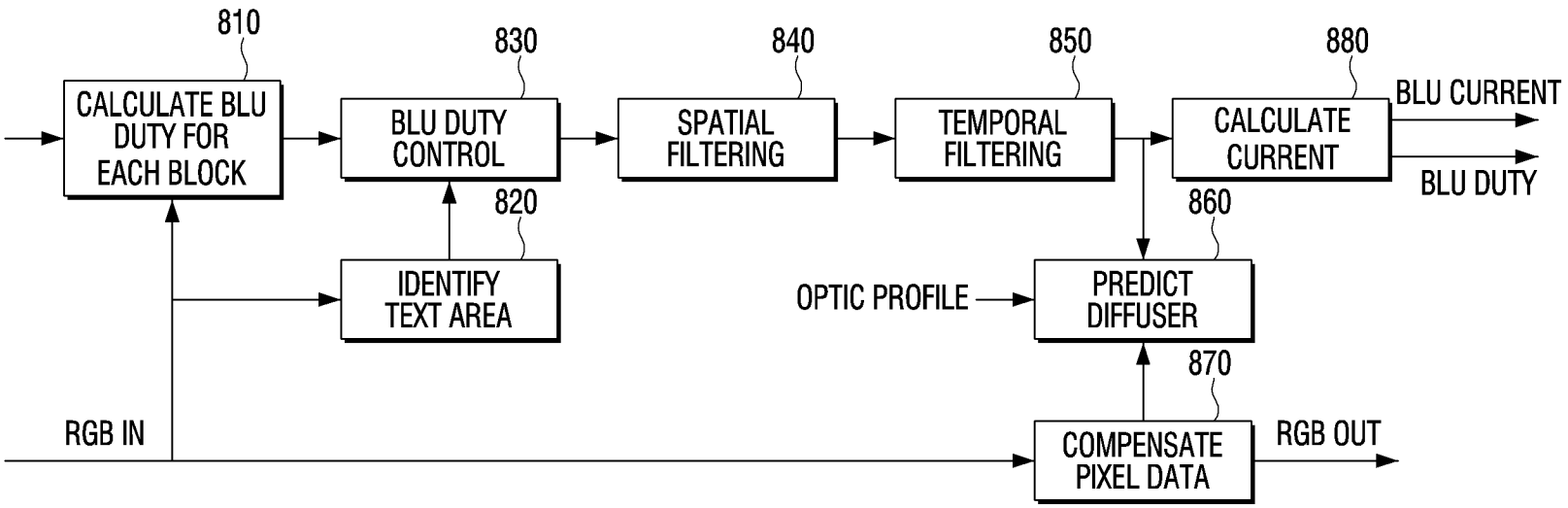
FIG. 8 is a block diagram sequentially illustrating an image processing operation according to an embodiment of the disclosure.

FIG. 8 is a block diagram sequentially illustrating an image processing operation according to an embodiment of the disclosure.

According to an embodiment of the disclosure, the processor 130 may first calculate a current duty for each backlight block based on an input image (810). Specifically, the processor 130 may calculate a current duty for each backlight block based on RGB pixel information of an image area corresponding to each backlight block in a current image frame.

The processor 130 may identify a position of a text area, for example, a subtitle position, in a predetermined frame interval (e.g., a current frame) (820). A detection of the position of the subtitle may be performed in various ways described above.

The processor 130 may correct the current duty calculated at block 810 based on the pixel information of the identified text area. For example, the current duty may be corrected by applying a gain value corresponding to an average value (or a maximum value or a sum value) of the pixel values of the text area to the current duty for each backlight block calculated at the block 810.

However, an order of blocks 810 to 830 is only an example, and after first identifying the position of the text area in the image, the current duty for each backlight block may be calculated based on pixel information of the remaining areas excluding pixel information of the corresponding area.

In addition, the processor 130 may perform spatial filtering 840 to reduce a dimming difference between each backlight block.

Figure 9A:
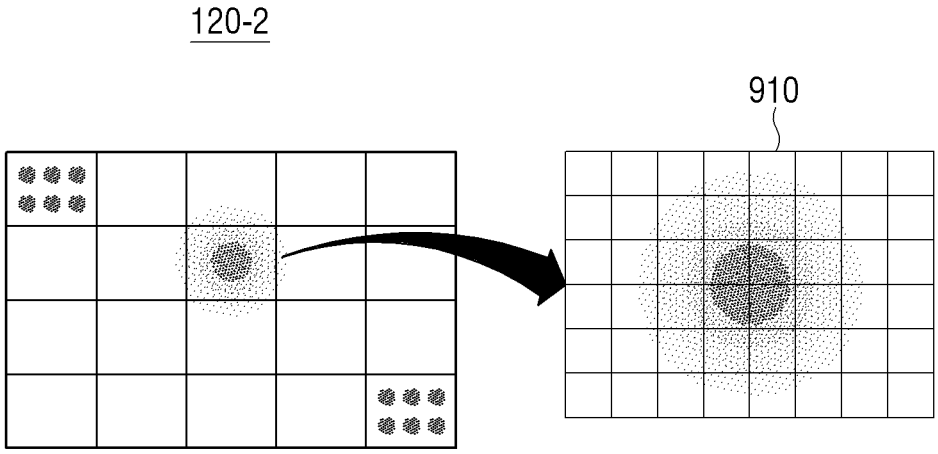
FIGS. 9A and 9B are views illustrating a spatial filtering method according to an embodiment of the disclosure.
Figure 9B:
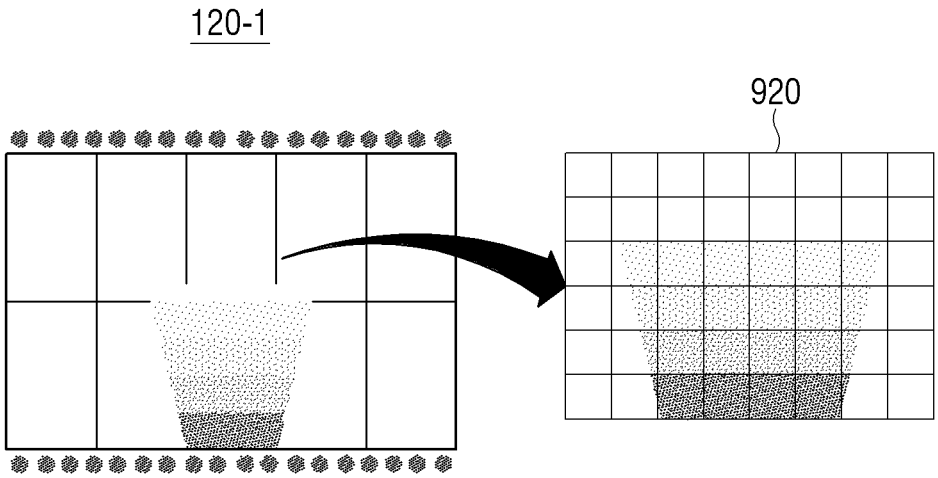

FIGS. 9A and 9B are views illustrating a spatial filtering method according to an embodiment of the disclosure.

If a local dimming is performed, a halo phenomenon may occur due to a dimming difference between each backlight block. In order to prevent this phenomenon, according to an embodiment of the disclosure, the processor 130 may perform a spatial filtering (or duty spread adjustment) on the current duty of each block to mitigate the dimming difference between each backlight block. For example, the processor 130 may adjust the current duty of the corresponding block based on the current duty of neighboring blocks of each backlight block. For example, the processor may reduce the dimming difference between adjacent blocks by adjusting the current duty of the current block with a filtering method in which a spatial filter having a window of a specific size (e.g., 3×3 size) is applied by assigning a specific weight to the current duty of each of eight blocks adjacent to the current duty of the current block.

The processor 130 may perform temporal filtering to reduce a difference in luminance according to a change in an image (850).

In general, when local dimming is performed, a flicker phenomenon may occur due to a difference in luminance according to a change in an image. In order to prevent the phenomenon from occurring, according to an embodiment of the disclosure, the temporal filtering may be performed such that a luminance change of the backlight unit 120 according to an image frame occurs smoothly. For example, the processor 130 may compare Nth dimming data corresponding to a current frame and N−1th dimming data corresponding to a previous frame, and perform filtering such that a luminance change of the backlight unit 120 is slow for a certain period of time according to the comparison result.

Also, the processor 130 may compensate for pixel data based on a light profile of the backlight unit 120. Specifically, the processor 130 may analyze a light profile of a light source of a backlight to predict (860) light diffuser, and compensate pixel data based on the prediction result (870).

FIG. 9A shows a light profile of a light source of a direct type backlight unit 120-1 according to an embodiment of the disclosure, and FIG. 9B shows a light profile of an edge type backlight unit 120-2 according to another embodiment of the disclosure. As illustrated in FIGS. 9A and 9B, the processor 130 may compensate for pixel data by predicting the light diffuser based on each back light block or a light profile of each light source included in each of the light blocks. For example, when a light diffuser value affecting a specific pixel is high, a gradation value of the corresponding pixel may be adjusted to decrease.

Figure 10:
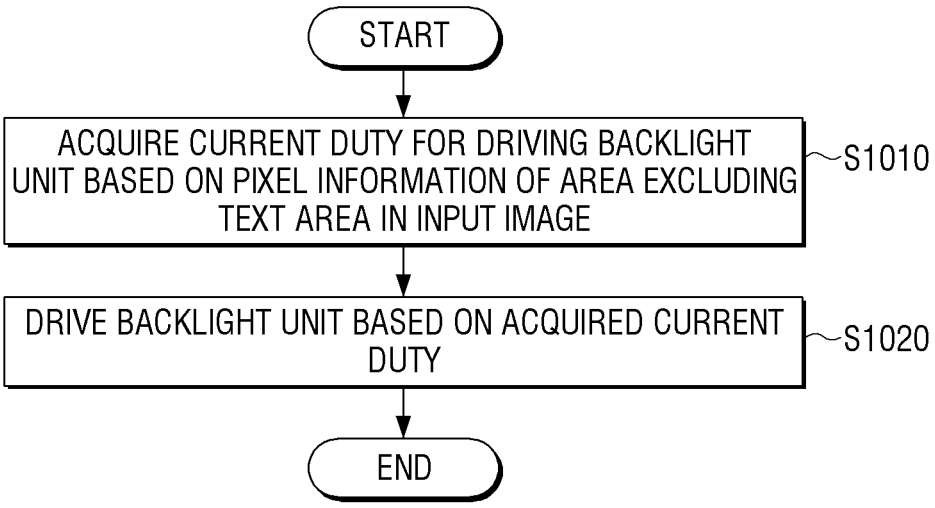
FIG. 10 is a flowchart illustrating a method of driving a display apparatus according to an embodiment of the disclosure.

FIG. 10 is a flowchart illustrating a method of controlling a display apparatus according to an embodiment of the disclosure.

According to the method of driving the display apparatus illustrated in FIG. 10, a current duty for driving a backlight unit is obtained based on pixel information of an area other than a text area in an input image (S1010). The text area may include at least one of a caption area and a logo area.

The backlight unit is driven based on the obtained current duty (S1020).

The operation of obtaining the current duty may identify the input image as a plurality of block areas, obtain feature information of each block area, and identify text area based on the obtained feature information. The feature information may include at least one of first pixel information including pixel values equal to or greater than a predetermined threshold gradation or second pixel information including edge area pixel values.

The operation of S1010 of obtaining the current duty may identify a text area based on at least one of at least one ratio among the first pixel information and the second pixel information, a center of gravity, or a degree of dispersion.

The backlight unit may include a plurality of backlight blocks, and the operation of obtaining a current duty may identify the input image as a plurality of areas corresponding to each of the plurality of backlight blocks, and a plurality of current duties for driving the plurality of backlight blocks corresponding to the plurality of areas.

In addition, the operation S1010 of acquiring the current duty, when position information on the text area is received, the position of the text area in the input image may be identified based on the position information.

According to the various embodiments described above, even if high-gradation text such as subtitles is included in an image, a change in brightness and deterioration of black visibility may be prevented, thereby improving user convenience.

Meanwhile, in the embodiments described above, for example, it has been described that the current duty for a backlight dimming is calculated by the display apparatus, but in some cases, the current duty may be calculated by a separate image processing device (not shown) without a display panel. For example, the image processing device may be implemented as various devices capable of image processing, such as a set-top box, a sending box, or the like that provide an image signal to the display panel.

Meanwhile, the methods according to various embodiments of the disclosure described above may be implemented in a form of an application that can be installed in an existing electronic device.

In addition, the methods described above according to various embodiments of the disclosure may be implemented only by software upgrade or hardware upgrade of the existing electronic device.

In addition, the various embodiments of the disclosure described above may be performed through an embedded server provided in an electronic device or an external server of at least one of an electronic device and a display apparatus.

According to an embodiment, the various embodiments described above may be implemented as software including instructions stored in a machine-readable storage media which is readable by a machine (e.g., a computer). The device may include the electronic device according to the disclosed embodiments, as a device which calls the stored instructions from the storage media and which is operable according to the called instructions. When the instructions are executed by a processor, the processor may directory perform functions corresponding to the instructions using other components or the functions may be performed under a control of the processor. The instructions may include code generated or executed by a compiler or an interpreter. The machine-readable storage media may be provided in a form of a non-transitory storage media. The 'non-transitory' means that the storage media does not include a signal and is tangible, but does not distinguish whether data is stored semi-permanently or temporarily in the storage media.

In addition, according to an embodiment, the methods according to various embodiments described above may be provided as a part of a computer program product. The computer program product may be traded between a seller and a buyer. The computer program product may be distributed in a form of the machine-readable storage media (e.g., compact disc read only memory (CD-ROM) or distributed online through an application store (e.g., PlayStore™). In a case of the online distribution, at least a portion of the computer program product may be at least temporarily stored or provisionally generated on the storage media such as a manufacturer's server, the application store's server, or a memory in a relay server.

Further, each of the components (e.g., modules or programs) according to the various embodiments described above may be composed of a single entity or a plurality of entities, and some subcomponents of the above-mentioned subcomponents may be omitted or the other subcomponents may be further included to the various embodiments. Generally, or additionally, some components (e.g., modules or programs) may be integrated into a single entity to perform the same or similar functions performed by each respective component prior to integration. Operations performed by a module, a program, or other component, according to various embodiments, may be sequential, parallel, or both, executed iteratively or heuristically, or at least some operations may be performed in a different order, omitted, or other operations may be added.

The foregoing example embodiments of the disclosure have been illustrated and described, but the disclosure is not limited to the specific embodiments described above, and various modifications may be made by those skilled in the art without departing from the gist of the disclosure claimed in the claims, and these modifications should not be understood individually from the technical idea or perspective of the disclosure.

What is claimed is:

1. A display apparatus comprising:

a display panel;

a backlight unit configured to provide light to the display panel; and a processor configured to drive the backlight unit, wherein to drive the backlight unit comprises to:

acquire, based on pixel information of an area excluding a text area in an input image, a current duty for driving the backlight unit, the text area having been identified based on a ratio of edge area pixels of the input image; and drive, based on the acquired current duty, the backlight unit, wherein the processor is further configured to identify the text area based on a difference between a plurality of first centers of gravity of first pixels and a plurality of second centers of gravity of second pixels, the first pixels having gradation pixel values that exceed a gradation threshold, and the second pixels having edge pixel values within a predetermined range.

2. The display apparatus of claim 1, wherein the processor is further configured to:

identify the input image as a plurality of block areas;

acquire feature information on each block area of the plurality of block areas; and identify the text area based on the acquired feature information.

3. The display apparatus of claim 2, wherein the feature information is configured to include at least one of first pixel information including pixel values equal to or greater than a predetermined threshold gradation or second pixel information including edge area pixel values.

4. The display apparatus of claim 3, wherein the processor is configured to identify the text area based on at least one among at least one ratio of the first pixel information or the second pixel information.

5. The display apparatus of claim 1, wherein the backlight unit comprises a plurality of backlight blocks; and wherein the processor is further configured to:

identify the input image as a plurality of areas corresponding to the plurality of backlight blocks, respectively; and acquire a plurality of current duties for driving the plurality of backlight blocks corresponding to the plurality of areas based on pixel information excluding pixel information of an area corresponding to the text area in the plurality of areas, respectively.

6. The display apparatus of claim 1, wherein the processor is further configured to, based on position information on the text area being received, identify a position of the text area in the input image based on the position information.

7. The display apparatus of claim 1, wherein the text area is configured to include at least one of a subtitle area or a log area.

8. The display apparatus of claim 1, wherein the display panel is a liquid crystal panel.

9. A method of driving a display apparatus, comprising:

acquiring a current duty configured to drive a backlight unit based on pixel information of an area excluding a text area in an input image, the text area having been identified based on a ratio of edge area pixels of the input image; and driving, based on the acquired current duty, the backlight unit, wherein the identifying of the current duty comprises identifying the text area based on a difference between a plurality of first centers of gravity of first pixels and a plurality of second centers of gravity of second pixels, the first pixels having gradation pixel values that exceed a gradation threshold, and the second pixels having edge pixel values within a predetermined range.

10. The method of claim 9, wherein the acquiring of the current duty comprises:

identifying the input image as a plurality of block areas;

acquiring feature information on each block area of the plurality of block areas; and identifying the text area based on the acquired feature information.

11. The method of claim 10, wherein the feature information is configured to include at least one of first pixel information including pixel values equal to or greater than a predetermined threshold gradation or second pixel information including edge area pixel values.

12. The method of claim 11, wherein the identifying of the current duty comprises identifying the text area based on at least one among at least one ratio of the first pixel information or the second pixel information.

13. The method of claim 9, wherein the identifying of the current duty comprises:

identifying the input image as a plurality of areas corresponding to a plurality of backlight blocks of the backlight unit, respectively; and acquiring a plurality of current duties for driving the plurality of backlight blocks corresponding to the plurality of areas based on pixel information excluding pixel information of an area corresponding to the text area in the plurality of areas, respectively.

14. The method of claim 9, wherein the acquiring of the current duty comprises, based on position information on the text area being received, identifying a position of the text area in the input image based on the position information.

15. The method of claim 9, wherein the text area is configured to include at least one of a subtitle area or a log area.

16. A display apparatus comprising:

a display panel;

a backlight unit configured to provide light to the display panel; and a processor configured to drive the backlight unit, wherein to drive the backlight unit comprises to:

acquire, based on pixel information of an area excluding a text area in an input image, a current duty for driving the backlight unit, the text area having been identified based on a ratio of edge area pixels of the input image; and drive, based on the acquired current duty, the backlight unit, wherein the processor is further configured to identify the text area based on a degree to which a particular pixel physical quantity is distributed, the particular pixel physical quantity being at least one of a first gradation value that is inferior to a gradation threshold and a second gradation value that exceeds the gradation threshold.

* * * * *